US006860021B1

(12) United States Patent
Connelly, III

(10) Patent No.: US 6,860,021 B1
(45) Date of Patent: Mar. 1, 2005

(54) SELF-ALIGNING PEEP SIGHT SYSTEM

(76) Inventor: William L. Connelly, III, 5603 E. Hop Toad Rd., Kingman, AZ (US) 86401

( * ) Notice: Subject to any disclaimer, the term of this patent is extended or adjusted under 35 U.S.C. 154(b) by 0 days.

(21) Appl. No.: 10/624,239

(22) Filed: Jul. 21, 2003

(51) Int. Cl.[7] ..... F41G 1/00
(52) U.S. Cl. ..... 33/265; 124/87
(58) Field of Search ..... 33/265; 124/87

(56) References Cited

U.S. PATENT DOCUMENTS 3,071,127 A * 1/1963 Spack ..... 124/17
4,116,194 A * 9/1978 Topel ..... 124/87
4,552,121 A * 11/1985 Treaster ..... 124/87
4,563,821 A * 1/1986 Saunders ..... 33/265
4,656,747 A * 4/1987 Troncoso ..... 33/265
4,848,306 A * 7/1989 Treaster ..... 124/24.1
4,961,264 A * 10/1990 Topel ..... 33/265
4,965,938 A * 10/1990 Saunders ..... 33/265
5,148,603 A * 9/1992 Beutler ..... 33/265
5,253,423 A * 10/1993 Sullivan et al. ..... 33/265
5,379,747 A * 1/1995 Morris et al. ..... 124/87
5,996,569 A * 12/1999 Wilson ..... 124/87
6,024,079 A 2/2000 Ingle et al.
6,131,295 A * 10/2000 Cranston ..... 33/265
6,170,164 B1 1/2001 Knowles

* cited by examiner

*Primary Examiner*—Christopher W. Fulton
*Assistant Examiner*—Tania Courson
(74) *Attorney, Agent, or Firm*—Schmeiser, Olsen & Watts, LLP

(57) ABSTRACT

Disclosed are embodiments of a self-aligning peep sight system for mounting on an archery bow for sighting a target. Self-aligning peep sight systems may provided: a balanced, symmetrical peep sight; a securely served, non-sliding peep sight; a large sight aperture; a visible, thinner, durable, solid tether; and/or safe, secure, adjustable tether/cable and tether/peep sight interfaces. Particular embodiments may comprise a peep sight having a body with a thickness and a serving channel girdling the body at the midpoint of its thickness separating a front and rear face. Sight and tether-securing apertures may extend through the body. The tether may be formed of a thermoplastic elastomer and may have an end portion substantially retained within the peep sight and an opposing end portion substantially retained within internal tether channels of the interfacing clip.

20 Claims, 5 Drawing Sheets

SELF-ALIGNING PEEP SIGHT SYSTEM

BACKGROUND OF THE INVENTION

1. Technical Field

This invention generally relates to the field of archery, and more specifically to a self-aligning peep sight system.

2. Background Art

The necessity for more accurate aiming of an archery bow has been present since the advent of the bow. There have been numerous sights that attempt to perform such aiming. Some of the existing sights are self-aligning peep sights that attach to multi-strand bowstrings typical on compound bows. All conventional peep sights, however, have at least two inherent problems.

First, conventionally served peep sights slide in the bowstrings. Placing the peep sight between the strands of the bowstring and tying separate serving string around the bowstring strands both above and below the peep sight accomplish serving a conventional peep sight into multi-strand bowstring. However, this conventional manner of serving the peep sight does not prevent sliding of the peep sight up or down the bowstring. Therefore, repeatedly fully drawing the bowstring causes the peep sight to slide in the bowstring due to the tension on the split strings, thereby compromising the aiming.

Second, conventional tethers are not durable and readily visible. Conventional self-aligning peep sights use a length of hollow tubing as a tether. One end of the hollow tubing is either crudely attached to the power cable with an overhand knot or is attached to the power cable by a split plastic clip that wraps around the power cable forming a protrusion that is then inserted into the hollow tubing. A fixed protrusion located on the peep site inserts into the other end of the hollow tubing.

However, not only is hollow tubing not very visible in all light conditions, hollow tubing is not durable. That is, the interfacing of the hollow tubing with the power cable in conventional peep sight systems is not reliable. The hollow tubing always breaks or slips/stretches, typically within a few months, primarily due to stress points at the tubing/peep sight protrusion interface and/or the tubing/split clip protrusion interface. This forces an archer to cut the broken or stretched ends of the tubing and then reinsert them back onto the protrusions. However, shortened hollow tubing causes compromised and inaccurate aiming. That is, shortened hollow tubing increases tension on the peep sight, in turn causing increased tension on the string, resulting in the tail of the arrow pulling up on release from the bow, thereby causing a low shot. Alternatively, the knot may be untied with use over time, and adjusting it requires the untying and then re-tying. Archers and manufacturers try and compensate for these breaking issues by employing larger tubing. However, larger tubing causes, among other drawbacks, velocity loss of an arrow due to the drag of the tubing.

Accordingly, archers need an improved self-aligning peep sight system that overcomes, among other problems, the peep sight sliding and non-secure tubing/power cable and tubing/peep sight interfacing drawbacks of conventional peep sights.

DISCLOSURE OF THE INVENTION

The present invention may be readily adapted to a variety of self-aligning peep sight systems for mounting on archery bows for sighting targets. Embodiments of the present invention may provide, among other benefits: a balanced, symmetrical peep sight (e.g. elliptical); a securely served, non-sliding peep sight; a large sight aperture; a visible, thinner, durable, solid tether; and safe, secure, adjustable tether/cable and tether/peep sight interfaces.

In particular embodiments, the present invention provides a self-aligning peep sight system that may comprise a peep sight that may include a body with a thickness. A serving channel may girdle the peep sight body substantially at the midpoint of its thickness, thereby separating a front face of the peep sight form a rear face of the peep sight. A serving hole may be integral in the peep sight body and may extend through a width of the peep sight body connecting opposing serving channel portions. A sight aperture and a tether-securing aperture may also be integral in the peep sight body and may extend through the thickness of the peep sight body from the front face to the rear face of the peep sight. The tether may have opposing first and second end portions, the first end portion retained within the peep sight body and the second end portion retained within the interfacing clip. Moving the bowstring into the fully drawn position tightens the tether, which causes the peep sight to pivot into an aligned position. The interfacing clip may have internal tether channels and internal power cable channels. These channels allow the interfacing clip to removably couple the tether and the power cable therein at the same time.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings, where like designations denote like elements.

DESCRIPTION OF THE INVENTION

Figure 2:
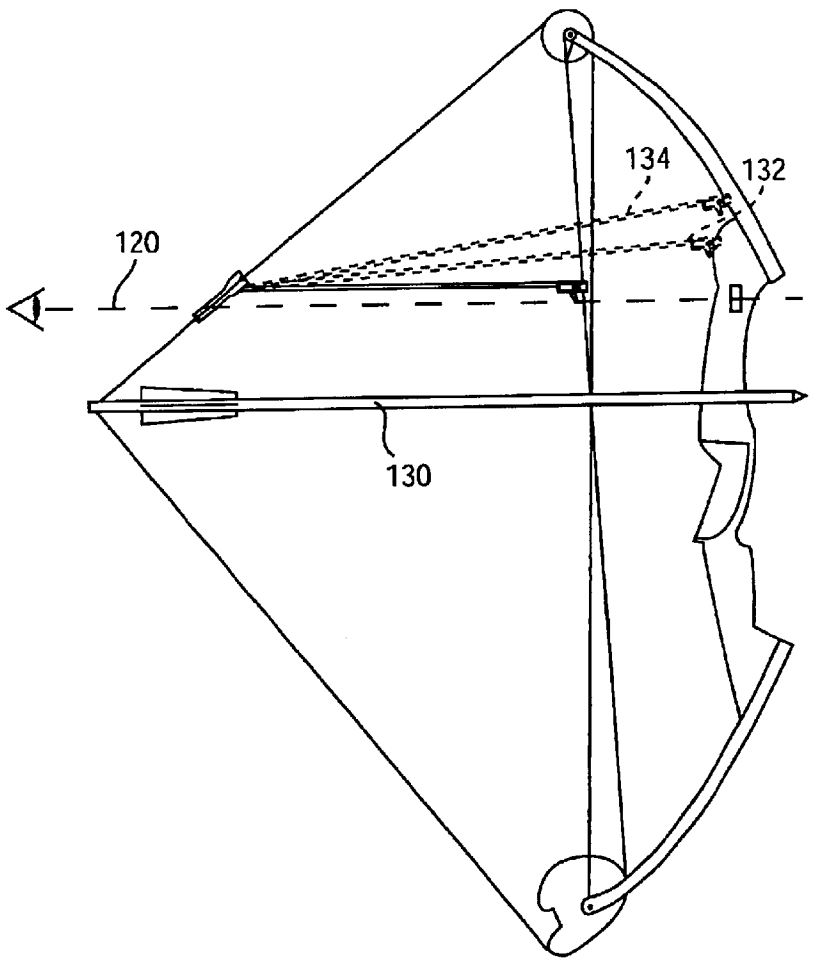
FIG. 2 is a side view of the peep sight system and archery bow of FIG. 1 with the archery bow in a fully drawn position.

As discussed above, embodiments of the present invention relate to a self-aligning peep sight system for mounting on an archery bow for sighting a target. Embodiments of a self-aligning peep sight system of the invention may generally comprise a peep sight for mounting between strings of a multi-strand bowstring on an archery bow, a tether for providing the necessary tension to pivot the peep sight into an aligned position, and an interfacing clip for securing the tether to one of a power cable, a limb, and a riser of an archery bow.

Accordingly, although the invention may be readily adapted to a variety of embodiments of a self-aligning peep sight system, with reference to FIGS. 1–2 and 8–9, self-aligning peep sight system 20 is an example of a self-aligning peep sight system of the invention. Self-aligning peep sight system 20 generally includes peep sight 22, interfacing clip 60, and tether 40, wherein end portions of tether 40 are respectively retained by and coupled substantially within peep sight 22 and interfacing clip 60.

Referring to FIGS. 3–4 and 8–13, peep sight 22 includes peep sight body 26, front face 24, rear face 34, tether-securing aperture 30, sight aperture 32, serving channel 28, and serving hole 104. Peep sight body 26 has a thickness that separates front face 24 and rear face 34. Tether-securing aperture 30 and sight aperture 32 each run through the entire thickness of peep sight body 26 having openings on front face 24 and opposing openings on rear face 34. Tether-securing aperture 30 is located substantially in an upper portion of peep sight 22, with the opening on front face 24 being lower than the opening on rear face 34. Sight aperture 32 is located substantially in a lower portion of peep sight 22 with the opening on front face 24 being lower than the opening on rear face 34, such that the axis of tether-securing aperture 30 and sight aperture 32 are substantially parallel.

Figure 5:
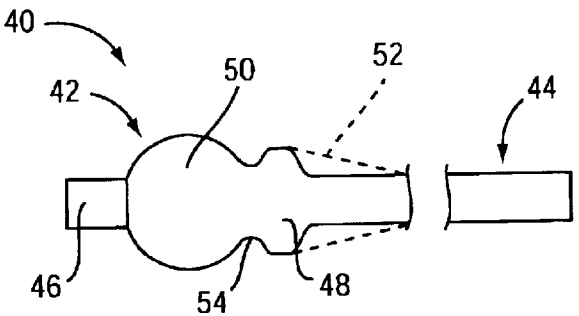
FIG. 5 is a side view of a tether configured according to an embodiment of the present invention of the peep sight system of FIG. 1.
Figure 4:
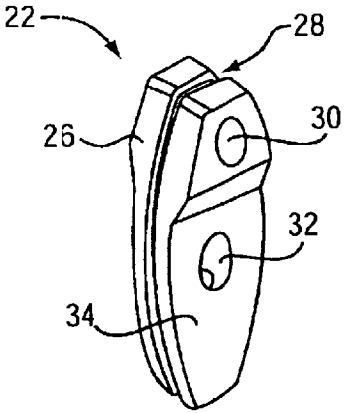
FIG. 4 is a rear perspective view of the peep sight of FIG. 3.
Figure 3:
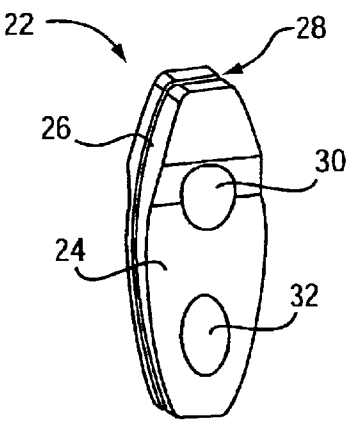
FIG. 3 is a front perspective view of a peep sight configured according to an embodiment of the present invention of the peep sight system of FIG. 1.
Figure 7:
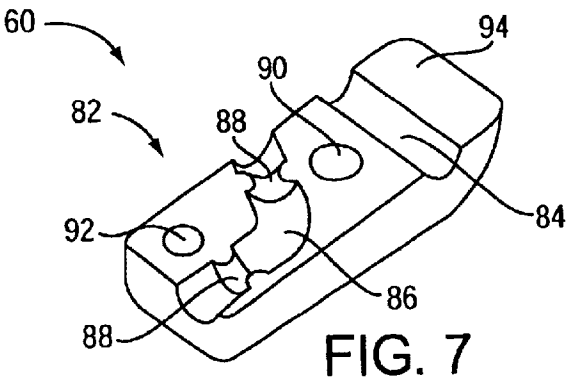
FIGS. 6–7 are perspective views of a first side and a second side respectively of an interfacing clip configured according to an embodiment of the present invention of the peep sight system of FIG. 1.
Figure 6:
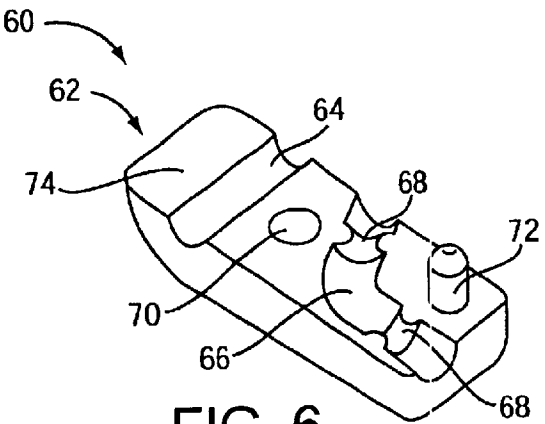
Figure 8:
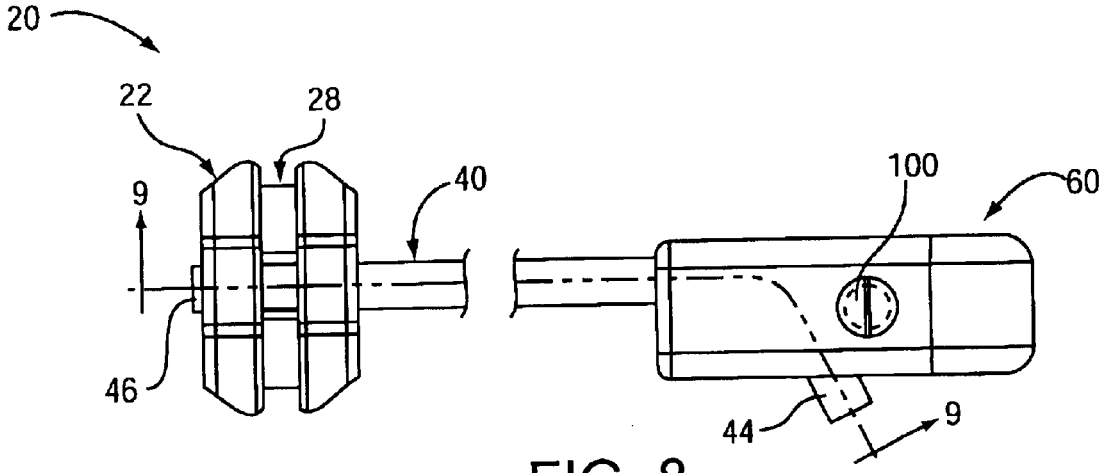
FIG. 8 is a combination of a top view of the peep sight and a side view of the interfacing clip, both of the peep sight system of FIG. 1, to facilitate the section view of FIG. 9 through the tether.

For the exemplary purposes of this disclosure, tether-securing aperture 30 is of a complimentary configuration to first end portion 42 of tether 40 (FIG. 5) so as to create a press fit sleeve around first end portion 42. The shape of sight aperture 32 may comprise any rectilinear (e.g. square and the like), curvilinear (e.g. circular, conical, oval, and the like), or any combination thereof shape. For the exemplary purposes of this disclosure, sight aperture 32 is comprised of opposing and integrally joined/abutting conical frustums (e.g. truncated right circular cones with truncation planes parallel with bases), the base of one cone comprising the opening on front face 24 and the base of the opposing cone comprising the opening on rear face 34.

Figure 1:
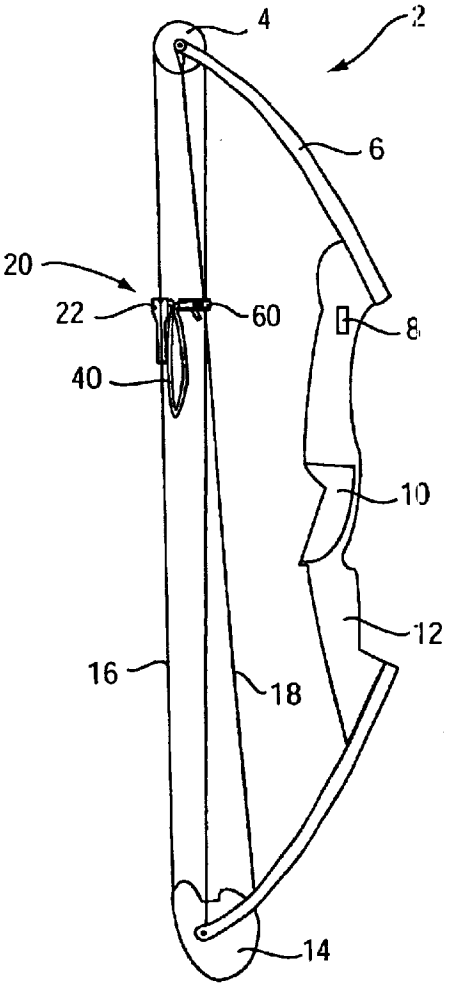
FIG. 1 is a side view of a peep sight system configured according to an embodiment of the present invention in conjunction an archery bow in a relaxed position.
Figure 9:
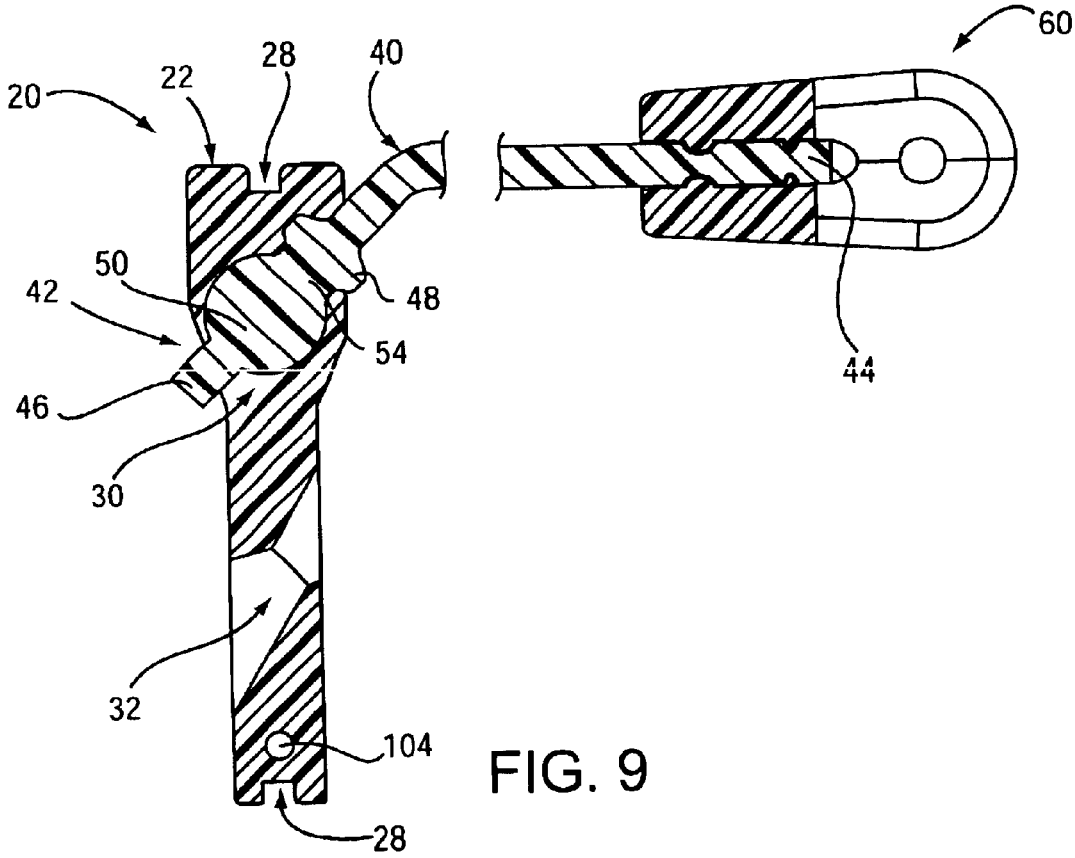
FIG. 9 is a section view of the peep sight system of FIG. 1 taken along line 9—9 of FIG. 8.
Figure 10:
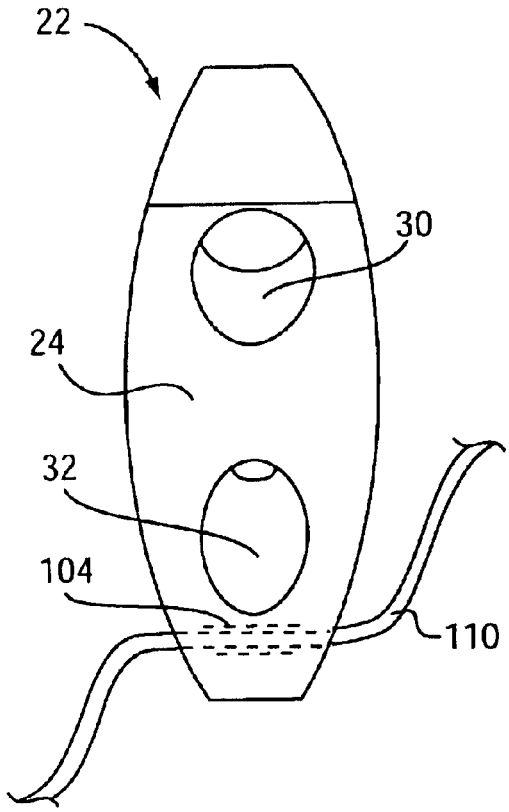
FIG. 10 is a front view of the peep sight of FIG. 3 before serving in a bowstring of the archery bow of FIG. 1.
Figure 11:
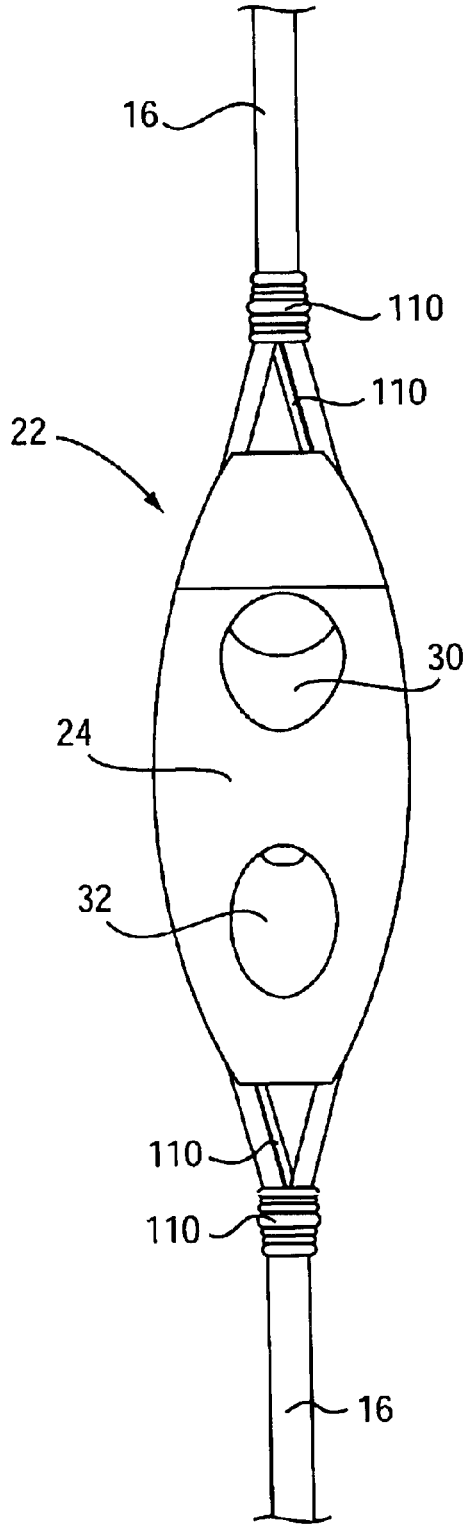
FIG. 11 is a front view of the peep sight of FIG. 3 served in the bowstring of the archery bow of FIG. 1.

Serving channel 28 provides a groove that accommodates at least one strand of bowstring 16 of archery bow 2 (FIG. 1). Serving channel 28 girdles peep sight body 26 along the perimeter of peep sight 22, dividing front face 24 and rear face 34 of peep sight 22. For the exemplary purposes of this disclosure, serving channel 28 girdles peep sight body 26 substantially at the midpoint of its thickness. Serving hole 104 may be integral in peep sight body 26 and may extend through a width of peep sight body 26 connecting opposing serving channel portions. For the exemplary purposes of this disclosure, serving hole 104 is cylindrical in shape and extends through a bottom width of peep sight body 26 connecting opposing serving channel portions as depicted in FIGS. 9 and 10.

Turning to FIGS. 1–2, 5, and 8–9, tether 40 includes first end portion 42 and opposing second end portion 44. First end portion 42 comprises tether removal member 46, first retaining member 48, second retaining member 50, and circumferential, curvilinear recess 54. Moreover, first end portion 42 may alternatively comprise first retaining member 52 to accomplish the same objective as first retaining member 48, while virtually removing any potential stress point. Second end portion 44 is cylindrical and the end of an elongated cylindrical portion of the tether 40. The first end portion 42 is configured to be removably coupled in tether-securing aperture 30 substantially within peep sight body 26, thereby creating a secure interface between tether 40 and peep sight 22. Second end portion 44 is configured to be removably coupled substantially within an interfacing clip 60 as will be discussed in greater detail hereinafter. For the exemplary purposes of this disclosure, tether 24 is a flexible, thin solid cord, such as a bungee-like cord, formed of a thermoplastic elastomer material.

Referring to FIGS. 1–2 and 6–9, interfacing clip 60 comprises first side 62 and second side 82. First side 62 comprises power cable channel 64, tether channel 66, a set of tether retaining ribs 68, first securing aperture 70 and alignment shaft 72. Second side 82 comprises power cable channel 84, tether channel 86, a set of tether retaining ribs 88, second securing aperture 90 and alignment recess 92. For the exemplary purposes of this disclosure, power cable channels 64 and 84 respectively are configured to be coupled to power cable 18 (FIG. 1), tether channels 66 and 86 respectively are configured to retain second end portion 44 of tether 40 by virtue of tether retaining ribs 68 and 88 respectively pinching the second end portion 44 (FIG. 9), and by virtue of tether channels 64 and 84 comprising bent or curved channels, thereby creating a secure interface between tether 40 and power cable 16. The simultaneous coupling of power cable 16 and retaining of tether 40 is accomplished by removably coupling first side 62 and second side 82 as will be discussed in greater detail hereinafter.

It will be understood by those of ordinary skill in the art that the invention is not limited to self-aligning peep sight system 20 and its components disclosed herein, as virtually any self-aligning peep sight system and components known in the art consistent with the intended operation of a self-aligning peep sight system of the invention for aiming an arrow of an archery bow may be utilized. Accordingly, for example, although particular peep sight systems, peep sights, peep sight front faces, peep sight bodies, serving channels, serving holes, tether-securing apertures, sight apertures, peep sight rear faces, tethers, tether first end portions, tether second end portions, tether removal members, tether first retaining members, tether second retaining members, tether circumferential, curvilinear recesses, interfacing clips, interfacing clip first sides, interfacing clip second sides, power cable channels, tether channels, tether retaining ribs, securing apertures, alignment shafts, alignment recesses, fasteners, serving string, and other components arc disclosed, such components may comprise any shape, size, style, type, model, version, measurement, material, and/or the like as is known in the art for such components consistent with the intended operation of a self-aligning peep sight system of the invention. It will also be understood by those of ordinary skill in the art that the invention is not limited to use of any specific components, provided that the components selected are consistent with the intended operation of a self-aligning peep sight system of the invention.

Accordingly, for the exemplary purposes of this disclosure, peep sight 22 may comprise a balanced, symmetrical elliptic shape that may have a height of approximately 1.4700 inches, a width at the widest portion of the front and rear faces 24 and 34 of approximately 0.5719 inches, and a depth of approximately 0.3454 inches and approximately 0.2000 inches at the thickest and narrowest depths between the front face 24 and rear face 34 respectively. Serving channel 28 may be approximately 0.0700 inches in width with one side of the channel approximately 0.0600 inches from the front face and the opposing channel side located approximately 0.0700 inches from the rear face. Sight aperture 32 may have a smallest diameter of approximately 0.3000 inches. Tether-securing aperture 30 may have a spherical portion having a radius of approximately 0.1400 inches, a cylindrical portion having a diameter of approximately 0.1600 inches, and yet another cylindrical portion with approximately a 0.2200 inch diameter, each portion in order from front face 24 to rear face 34. These measurements may correspond to measurements of first end portion 42 of tether 40, which may have a spherical portion having a radius of approximately 0.1400 inches, a cylindrical portion having a diameter of approximately 0.1500 inches, and another cylindrical portion having a diameter of approximately 0.2150 inches in diameter as depicted in FIG. 9. Interfacing clip 60 when coupled together may have a length of approximately 0.8313 inches, a width of approximately 0.3125 inches, and a depth at the thickest portion of approximately 0.4126 inches. Power cable channels 64 and 84 and tether channels 66 and 86 may have radii of curvature of approximately 0.0500 inches. Tether retaining ribs 68 and 88 may each have a radius of curvature of approximately 0.0313 inches and protrude approximately 0.0250 inches from the surface of tether channels 66 and 86 respectively. Tether channels 66 and 86 may each have approximately a 63.44-degree bend.

The components defining any self-aligning peep sight system embodiment of the invention may be formed of any of many different types of materials or combinations thereof that can readily be formed into shaped objects provided that the components selected are consistent with the intended mechanical operation of a self-aligning peep sight system of the invention. For example, the components may be formed of the following types of materials and/or any combinations thereof: rubber, such as synthetic, natural, and/or other like materials; composites such as fiberglass, carbon-fiber, and/or other like materials; polymers, such as plastic, polycarbonates, tinted polycarbonates, PVC plastic, ABS plastic, polystyrenes, nylon, phenolics, and/or other like materials; elastomers, such as thermoplastic elastomers and/or other like materials; metals, such as zinc, magnesium, copper, iron, steel, and/or other like materials; and/or alloys, such as aluminum and/or other like materials.

The components defining any self-aligning peep sight system embodiment of the invention may be purchased pre-manufactured or manufactured separately and then assembled together. However, any or all of the components may be manufactured simultaneously and integrally joined with one another. Manufacture of these components separately or simultaneously may involve extrusion, pultrusion, injection molding, resin transfer molding, casting, milling, cutting, welding, soldering, riveting, punching, stamping, and/or the like. If any of the components are manufactured separately, they may then be coupled with one another in any manner known in the art, such as with adhesive, a weld, a fastener (e.g. a bolt, a screw, a rivet), any combination thereof, and/or the like for example, depending on, among other considerations, the particular material forming the components. Other possible steps might include sand blasting, polishing, powder coating, and/or painting the components for example.

Accordingly, for the exemplary purposes of this disclosure, peep sight 22 may be formed of a tinted polycarbonate material with a polished finish, interfacing clip 60 may be formed of a black delrin material with a ground or 32 RMS finish, and tether 40 may be formed of a thermoplastic elastomer material with a 32 RMS finish.

Additionally, for the exemplary purposes of this disclosure, peep sight system 20 may be assembled as depicted in FIGS. 1–2 and 8–13. First, peep sight 22 may be removably served into bowstring 16. Serving peep sight 22 may be accomplished by threading serving string 110 through serving hole 104 in peep sight 22 (FIG. 10). This combination may then be inserted between strands of bowstring 16 above the midpoint on bowstring 16 (such that peep sight 22 is above arrow 130 when arrow 130 is positioned in bowstring 16 (FIG. 2)), thereby pinching serving string 110 between strands of bowstring 16. Serving string 110 then may be tied to the strands above and below peep sight 22, thereby serving peep sight 22 in a secure non-sliding position (FIG. 11) in contrast to conventionally served peep sights.

Second, tether 40 may be removably pulled through tether-securing aperture 30. Accordingly, first end portion 42 may be substantially within peep sight body 26, and tether removal member 46 may extend out of tether-securing aperture 30 on front face 24 of peep sight 22.

Third, first and second side 62 and 82 respectively of interfacing clip 60 may be removably coupled together while simultaneously removably coupling second end portion 42 of tether 40 and power cable 18 within interfacing clip 60. This may be accomplished by placing second end portion 44 and power cable 18 in tether channel 66 and power cable channel 64 respectively of first side 62. Second side 82 may then be coupled to first side 62, with first internal surface 74 and second internal surface 94 abutting each other. This may be accomplished by inserting alignment shaft 72 into alignment recess 92 while aligning tether channels 66 and 86 and aligning power cable channels 64 and 84, thereby compressing second end portion 44 and power cable 16 between each set of channels respectively. Fastener 100 may then be inserted and removably coupled into first and second securing apertures 70 and 90 respectively, thereby removably coupling interfacing clip 60, tether 40, and power cable 16 simultaneously.

While the assembly of peep sight system 20 has been described in a particular sequence of steps with reference to the drawing figures, it will be understood by those of ordinary skill in the art that the assembly of invention is not limited to the specific order of steps as disclosed. Any steps or sequence of steps of the assembly of any peep sight system embodiment of the invention indicated herein are given as examples of possible steps or sequence of steps and not as limitations, since various assembly processes and sequences of steps may be used to assemble a peep sight system of the invention on an archery bow.

For example, tether 40 may be pulled into tether-securing aperture 30 before serving peep sight 22. Furthermore, tether 40 may be pulled into tether-securing aperture 30 and interfacing clip may be coupled to tether 40 and power cable 18 before serving peep sight 22. Moreover, depending on, among other factors, the type of archery bow, interfacing clip 60 may alternatively be removably coupled to riser 12 (depicted as first alternate mounting 132 in FIG. 2) or to limb 6 (depicted as second alternate mounting 134 in FIG. 2) as opposed to power cable 18.

The invention is particularly useful in providing accurate aiming of a compound bow, such as those commonly used for hunting. Embodiments of the invention self-align the peep sight, correspond to any number of conventional front sites, reduce noise level, and reduce velocity loss of an arrow when released. However, it will be understood by those of ordinary skill in the art that the invention is not limited to uses relating to compound bows. Rather, any description relating to compound bows is for the exemplary purposes of this disclosure, and those of ordinary skill in the art will also understand that the invention may also be used in a variety of applications with similar results for a variety of archery bows, such as longbows, recurve bows, and the like.

In describing the use of the present invention further, although the invention may be readily adapted to a variety of embodiments of a self-aligning peep sight system, with reference to FIGS. 1–2 and 12–13 and for the exemplary purposes of this disclosure, self-aligning peep sight system 20 is shown in use with archery bow 2 of the compound type. Generally, compound archery bow 2 comprises a pulley 4, a limb 6, a front sight 8, a grip 10, a riser 12, a cam 14, a bowstring 16, and a power cable 18.

However, it will be understood by those of ordinary skill in the art that the invention is not limited to compound archery bow 2 and its components disclosed herein, as any compound archery bow and components known in the art consistent with the intended operation of a self-aligning peep sight system of the invention for aiming an arrow of an archery bow may be utilized. Accordingly, for example, although particular bow, pulley, limb, front sight, grip, riser, cam, bowstring, power cable, arrow, and other components are disclosed, such components may comprise any shape, size, style, type, model, version, measurement, material, and/or the like as is known in the art for such components consistent with the intended operation of a self-aligning peep sight system of the invention. It will also be understood by those of ordinary skill in the art that the invention is not limited to use of any specific components, provided that the components selected are consistent with the intended operation of a self-aligning peep sight system of the invention.

Figure 12:
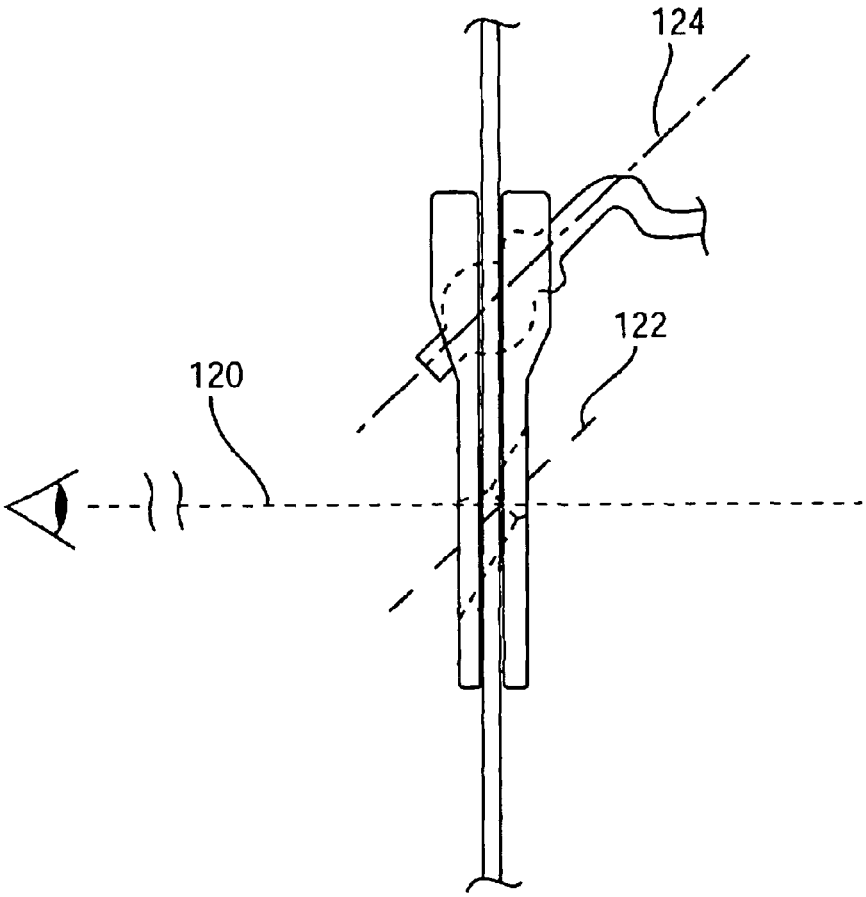
FIG. 12 is a side view of the served peep sight of FIG. 11 with the bowstring in a relaxed position.
Figure 13:
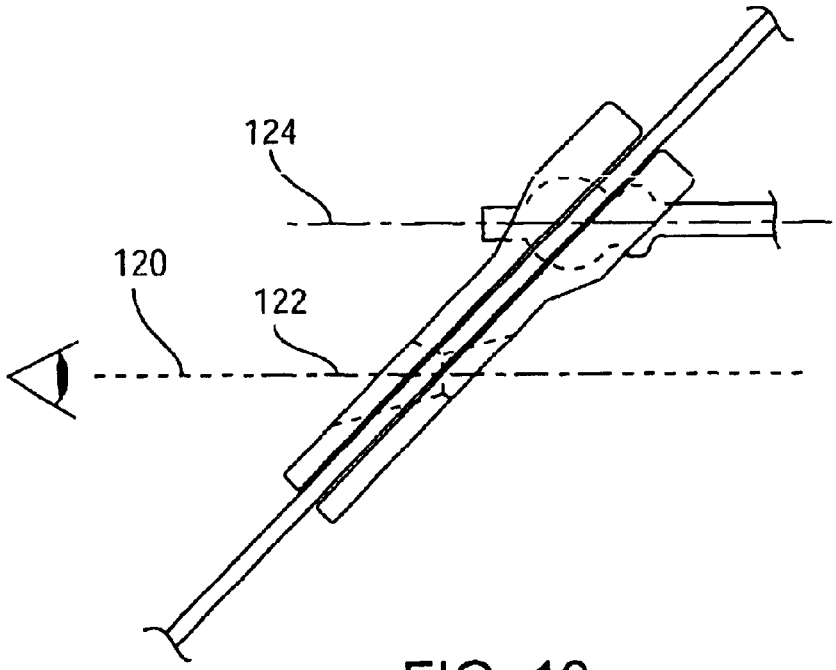
FIG. 13 is a side view of the served peep sight of FIG. 11 with the bowstring in a fully drawn position.

FIGS. 1 and 12 depicts peep sight system 20 mounted in multiple strand, bowstring 16 of bow 2 in a relaxed position. As specifically illustrated in FIG. 12, when in the relaxed position, line of sight 120, the sight aperture axis 122, and the tether axis 124 are not aligned. In use and turning to FIGS. 2 and 13, peep sight 22 is used in conjunction with front sight 8 mounted on riser 12 to allow the aiming and aligning of arrow 130 with a target (not shown). Accordingly, an archer (not shown) loads an arrow 130 in bow 2 such that arrow 130 engages the bowstring 16 below peep sight 22 and extends outward toward riser 12 of bow 2. To aim arrow 130, the archer draws bowstring 16 into the fully drawn position. As bowstring 16 is drawn, tether 40 becomes taut and pivots peep sight 22 on bowstring 16 such that line of sight 120 and sight aperture axis 122 are aligned, and line of sight 120, sight aperture axis 122, and tether axis 124 are parallel to the arrow 130 (FIG. 13). In this position, the archer aims bow 2 by sighting the target (not shown) through sight aperture 32 and aligning front sight 8 with the target (not shown).

Peep sight system 20 is particularly useful in conjunction with front sights having circular pin guards because sight aperture 32 of peep sight 22 may be over-sized. This is an added benefit for hunters, especially in low light situations. Accordingly, front sight 8 may be any number of well-known front sights with circular pin guards, such as any of the Spot-Hogg front sights provided by and through Spot-Hogg Archery Products, 125 Smith Street, PO Box 226, Harrisburg, Oreg. 97446. All Spot-Hogg sights come with circular pin guards and white alignment rings.

Thus, if front sight 8 is a Spot-Hogg front sight having a circular pin guard, the archer aims bow 2 by sighting the target (not shown) through sight aperture 32 and aligning the circular pin guard and white alignment ring of front sight 8 to accurately position front sight 8 with the target (not shown). Centering the pin guard and white alignment ring in peep sight 22 is very accurate and easy to duplicate. When an archer centers the pin guard, he is centering one circle inside of a slightly larger circle making it easier to tell when he is slightly off center.

Overall and for the exemplary purposes of this disclosure, use of embodiments of a self-aligning peep sight system of the present invention may provide various benefits and advantages over conventional peep sights. Peep sight embodiments of the invention may be balanced and symmetrical (e.g. elliptical), and may be securely served in a bowstring in a non-sliding fashion, thereby providing continued accuracy when using the peep sight system. Peep sight embodiments of the invention may also have a large sight aperture, which is particularly useful in conjunction with front sights having circular pin guards. This is an added benefit for hunters, especially in low light situations. In addition, peep sight embodiments of the invention provide a more secure and safe interfacing of the tether. Tether embodiments of the invention may be a visible, thinner, durable, solid tether. Such a flexible, solid tether allows the tether to easily withstand greater stresses and not break during normal and even rigorous use of the peep sight system. Also, the velocity loss of an arrow as it leaves the bowstring is reduced because there is less drag from the thinner, solid tether. Interfacing clip embodiments of the invention allow for easier adjustments to the tether for various types and sizes of archery bows, as well as a more secure and safe interfacing of the tether and the power cable.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation. Similarly, any steps or sequence of steps of methods indicated herein are given as examples of possible steps or sequence of steps and not as limitations.

What is claimed is:

1. A self-aligning peep sight system for mounting on an archery bow for sighting a target, the peep sight system comprising:

a peep sight comprising:

a sight body having a thickness extending between a front face and rear face and a width; and a sight aperture and a tether-securing aperture each extending from the front face to the rear face through the thickness of the sight body, the sight aperture adapted to allow a line of sight through the aperture when the archery bow is fully drawn, and the tether-securing aperture adapted to removably receive and retain a first end portion of a tether substantially within the sight body.

2. The system of claim 1, the peep sight further comprising:

a serving channel girdling the sight body substantially at the midpoint of its thickness, the serving channel adapted to accommodate at least one strand of a bowstring of the archery bow; and a serving hole extending through the width of the sight body connecting opposing swerving channel portions, the serving hole adapted to receive a serving string there through, thereby facilitating serving of the peep sight in a secure, non-sliding fashion.

3. The system of claim 1 further comprising a two-piece interfacing clip comprising:

a first side piece comprising:

a first internal face;

a first power cable channel in the first internal face; and a first tether channel in the first internal face; and a separate opposing second side piece comprising:

an opposing second internal face;

an opposing second power cable channel in the second internal face; and an opposing second tether channel in the second internal face;

wherein the opposing first and second power cable channels are adapted to removably receive and retain therein a portion of a power cable of the archery bow, and wherein the opposing first and second tether channels are adapted to removably receive and retain therein a second end portion of a tether.

4. The system of claim 1, further comprising the tether having opposing first and second end portions, the first end portion comprising at least one integral, protruding retaining member, the first end portion removably coupled into the tether-securing aperture substantially within the sight body, and the second end portion adapted to be removably coupled substantially within an interfacing clip, such that when the archery bow is moved into its fully drawn position, tension in the tether aligns the peep sight.

5. A self-aligning peep sight system for mounting on an archery bow for sighting a target, the peep sight system comprising:

a two-piece interfacing clip comprising:

a first side piece comprising:

a first internal face;

a first power cable channel in the first internal face; and a first tether channel in the first internal face; and a separate opposing second side piece comprising:

an opposing second internal face;

an opposing second power cable channel in the second internal face; and an opposing second tether channel in the second internal face;

wherein the opposing first and second power cable channels are adapted to removably receive and retain therein a portion of a power cable of the archery bow, and wherein the opposing first and second tether channels are adapted to removably receive and retain therein a second end portion of a tether.

6. The system of claim 5, wherein the first side piece of the interfacing clip further comprises a first securing aperture in the first internal face and an alignment shaft protruding from the first internal face, and wherein the second side piece of the interfacing clip further comprises a second securing aperture in the second internal face and an alignment recess in the second internal face, the first and second securing apertures adapted to receive a fastener for removably coupling the first side and the second side together and the alignment shaft and recess adapted to align the opposing tether channels and the opposing power cable channels.

7. The system of claim 5, wherein the opposing tether channels each further comprise at least one integral, protruding tether retaining rib crosswise therein.

8. The system of claim 5, wherein each of the opposing tether channels is bent.

9. The system of claim 5 further comprising a peep sight comprising:

a sight body having a thickness extending between a front face and rear face and a width; and a sight aperture and a tether-securing aperture each extending from the front face to the rear face through the thickness of the sight body, the sight aperture adapted to allow a line of sight through the aperture when the archery bow is fully drawn and the tether-securing aperture adapted to removably receive and retain a first end portion of the tether substantially within the sight body.

10. The system of claim 5 further comprising the tether having opposing first and second end portions, the first end portion comprising at least one integral, protruding retaining member, the first end portion adapted to be removably coupled into a tether-securing aperture substantially within a sight body of a peep sight, and the second end portion removably coupled substantially within the opposing tether channels, such that when the archery bow is moved into its fully drawn position, tension in the tether aligns the peep sight.

11. A self-aligning peep sight system for mounting on an archery bow for sighting a target, the peep sight system comprising:

a solid, thermoplastic elastomer tether having opposing first and second end portions, the first end portion comprising at least one integral, protruding retaining member, the first end portion adapted to be removably coupled into a tether-securing aperture substantially within a sight body of a peep sight, and the second end portion adapted to be removably coupled substantially within an interfacing clip, such that when the archery bow is moved into its fully drawn position, tension in the tether aligns the peep sight.

12. The system of claim 11, the at least one integral, protruding retaining member comprising a first integral, protruding retaining member and a second integral, protruding retaining member separated by an integral, circumferential, curvilinear recess, the first retaining member adapted to removably retain the first end portion of the tether in a tether-securing aperture of the peep sight when the self-aligning peep sight system is in use, the second retaining member adapted to removably retain the first end portion of the tether in the tether-securing aperture of the peep sight when the self-aligning peep sight system is not in use, and the circumferential, curvilinear recess adapted to removably couple to a retaining portion of the tether-securing aperture of the peep sight.

13. The system of claim 11 further comprising the peep sight comprising:

the sight body having a thickness extending between a front face and rear face and a width; and a sight aperture and the tether-securing aperture each extending from the front face to the rear face through the thickness of the sight body, the sight aperture adapted to allow a line of sight through the aperture when the archery bow is fully drawn, and the tether-securing aperture removably receiving and retaining the first end portion of the tether substantially within the sight body.

14. The system of claim 11 further comprising a two-piece interfacing clip comprising:

a first side piece comprising:
a first internal face:
a first power cable channel in the first internal face; and
a first tether channel in the first internal face; and a separate opposing second side piece comprising:
an opposing second internal face;
an opposing second power cable channel in the second internal face; and
an opposing second tether channel in the second internal face;

wherein the opposing first and second power cable channels are adapted to removably receive and retain therein a portion of a power cable of the archery bow, and wherein the opposing first and second tether channels removably receiving and retaining therein the second end portion of the tether.

15. A self-aligning peep sight system for mounting on an archery bow for sighting a target, the peep sight system comprising:

a peep sight comprising:
a sight body having a thickness extending between a front face and rear face and a width; and
a sight aperture and a tether-securing aperture each extending from the front face to the rear face through the thickness of the sight body, the sight aperture adapted to allow a line of sight through the aperture to the target when the archery bow is fully drawn;

a two-piece interfacing clip comprising:
a first side piece comprising:
a first internal face;
a first power cable channel in the first internal face; and
a first tether channel in the first internal face; and
a separate opposing second side piece comprising:
an opposing second internal face;
an opposing second power cable channel in the second internal face; and
an opposing second tether channel in the second internal face;
wherein the opposing first and second power cable channels are adapted to removably receive and retain therein a portion of a power cable of the archery bow; and a tether for positioning the peep sight in the aligned position where the line of sight is allowed through the sight aperture to the target, the tether having opposing first and second end portions, the first end portion comprising at least one integral, protruding retaining member, the first end portion removably coupled into the tether-securing aperture substantially within the sight body, and the second end portion removably coupled substantially within the opposing tether channels of the interfacing clip, such that when the archery bow is moved into its fully drawn position, tension in the tether aligns the peep sight.

16. The system of claim 15, the peep sight further comprising:

a serving channel girdling the sight body substantially at the midpoint of its thickness, the serving channel adapted to accommodate at least one strand of a bowstring of the archery bow; and a serving hole extending through the width of the sight body connecting opposing serving channel portions, the serving hole adapted to receive a serving string there through, thereby facilitating serving of the peep sight in a secure, non-sliding fashion.

17. The system of claim 15, wherein the first side piece of the interfacing clip further comprises a first securing aperture in the first internal face and an alignment shaft protruding from the first internal face, and wherein the second side piece of the interfacing clip further comprises a second securing aperture in the second internal face and an alignment recess in the second internal face, the alignment shaft inserted into the alignment recess, thereby aligning the opposing tether channels and the opposing power cable channels, and a fastener removably coupled into the first and second securing apertures, thereby removably coupling the first side piece of the interfacing clip to the second side piece of the interfacing clip.

18. The system of claim 15, wherein each of the opposing tether channels is bent and comprises at least one integral, protruding tether retaining rib crosswise therein.

19. The system of claim 15, wherein the tether comprises a solid, thermoplastic elastomer tether.

20. The system of claim 15, the at least one integral, protruding retaining member comprising a first integral, protruding retaining member and a second integral, protruding retaining member separated by an integral, circumferential, curvilinear recess, and the tether-securing aperture further comprising a press fit sleeve removably coupling the first and second retaining members and the circumferential, curvilinear recess.

* * * * *